US008915298B2

(12) United States Patent
Laird et al.

(10) Patent No.: US 8,915,298 B2
(45) **Date of Patent: *Dec. 23, 2014**

(54) SLICKLINE OR WIRELINE RUN HYDRAULIC MOTOR DRIVEN MILL

(75) Inventors: Mary L. Laird, Madisonville, LA (US); Robbie B. Colbert, Perdido, AL (US); David W. Coleman, Broussard, LA (US)

(73) Assignee: Baker Hughes Incorporated, Houston, TX (US)

( * ) Notice: Subject to any disclaimer, the term of this patent is extended or adjusted under 35 U.S.C. 154(b) by 215 days.

This patent is subject to a terminal disclaimer.

(21) Appl. No.: 13/587,634

(22) Filed: Aug. 16, 2012

(65) Prior Publication Data

US 2013/0153227 A1 Jun. 20, 2013

Related U.S. Application Data

(63) Continuation-in-part of application No. 12/795,292, filed on Jun. 7, 2010, now Pat. No. 8,403,048.

(51) Int. Cl.
*E21B 29/00* (2006.01)
*E21B 31/00* (2006.01)

(52) U.S. Cl.
CPC ..... *E21B 29/002* (2013.01); *E21B 31/00* (2013.01); *E21B 29/005* (2013.01)
USPC ..... 166/298; 166/55.7

(58) Field of Classification Search
USPC ..... 166/297, 298, 55.7, 55.8
See application file for complete search history.

(56) References Cited

U.S. PATENT DOCUMENTS

| | | | | |
|---|---|---|---|---|
| 2,280,769 | A | | 4/1942 | Page |
| 3,396,795 | A | | 8/1968 | Venghiattis |
| 3,920,070 | A | | 11/1975 | Goins |
| 5,577,560 | A | * | 11/1996 | Coronado et al. ..... 166/387 |
| 5,992,289 | A | | 11/1999 | George et al. |
| 6,035,880 | A | * | 3/2000 | Gazda ..... 137/68.16 |

(Continued)

FOREIGN PATENT DOCUMENTS

EP 481767 10/1991

OTHER PUBLICATIONS

Flett, C., et al., "The Application of Heavy Duty Wireline Fishing Techniques Retrieves Wellbore Obstruction and Allows Well to be Plugged and Full Integrity to be Retained", SPE 143240, Apr. 2011, 1-8.

(Continued)

*Primary Examiner* — William P Neuder
(74) *Attorney, Agent, or Firm* — Steve Rosenblatt

(57) ABSTRACT

A tool is run in with a bottom hole assembly that includes a seal and support within the tubing where a fish is to be milled. A ported sub allows pressurized fluid pumped from the surface to enter the bottom hole assembly above the sealed support location and to be directed to set an anchor and to a fluid driven motor such as a progressive cavity motor that is in turn connected milling tool at the rotor of the progressive cavity motor. The fluid exiting the stator goes through a debris removal device and can return to the surface through an annulus around the production tubing. A telescoping joint allows the mill to axially progress with a force applied to the fish generated by a tractor or a stack of Belleville washers.

24 Claims, 5 Drawing Sheets

(56) References Cited

U.S. PATENT DOCUMENTS

| | | | | |
|---|---|---|---|---|
| 7,086,467 | B2 | 8/2006 | Schlegelmilch et al. | |
| 7,225,873 | B2 | 6/2007 | Schlegelmilch et al. | |
| 7,370,703 | B2 | 5/2008 | Hill et al. | |
| 7,478,982 | B2 | 1/2009 | Fuhst et al. | |
| 7,546,876 | B2 | 6/2009 | McAfee | |
| 7,575,056 | B2 | 8/2009 | Fuhst et al. | |
| 7,802,949 | B2 | 9/2010 | Fuhst et al. | |
| 8,151,902 | B2 | 4/2012 | Lynde et al. | |
| 8,210,251 | B2 | 7/2012 | Lynde et al. | |
| 8,403,048 | B2 * | 3/2013 | Laird et al. | 166/298 |
| 2003/0066650 | A1 | 4/2003 | Fontana et al. | |
| 2004/0163808 | A1 | 8/2004 | Ringgenberg et al. | |
| 2010/0089583 | A1 | 4/2010 | Xu et al. | |

OTHER PUBLICATIONS

Foster, Jerry, et al., "Slickline-Deployed Electro-Mechanical Intervention System, a Cost-Effective Alternative to Traditional Cased-Hole Services", SPE 67201, Mar. 2001, 1-14.

Foster, Jerry, et al., "Slickline-Deployed Electro-Mechanical Intervention System: A Cost-Effective Alternative to Traditional Cased-Hole Services", SPE 70031, May 2001, 1-15.

* cited by examiner

SLICKLINE OR WIRELINE RUN HYDRAULIC MOTOR DRIVEN MILL

CROSS REFERENCE TO RELATED APPLICATION

This application is a continuation-in-part of U.S. patent application Ser. No. 12/795,292, filed on Jun. 7, 2010, and claims the benefit of priority from the aforementioned application.

FIELD OF THE INVENTION

The field of this invention is mills and more specifically those that are rotatably driven by a bottom hole assembly suspended from the surface with a cable or wireline while a motor in the assembly powers the mill using fluid flow into the tubular and most specifically a washover mill with an advancing feature in the bottom hole assembly (BHA) to advance the mill as the milling progresses.

BACKGROUND OF THE INVENTION

Tubing cutters have been run into a subterranean location into tubing that is to be cut on coiled tubing and/or tubular. The coiled tubing or tubular has fluid pumped through it to power a downhole motor that is fluid driven such as a progressing cavity pump. The rotation of the pump drives the cutter after extending its blades. Some examples are U.S. Pat. Nos. 7,225,873 and 7,086,467. Coiled tubing units are frequently not at a well site and are very expensive to deploy.

Older designs would cut tubing using explosive charges that are set off with a dropped weight on a slickline such as illustrated in U.S. Pat. No. 5,992,289. These tools did not rotate and the positioning of the explosives made the circumferential cut. These designs had the obvious safety issues of dealing with explosives. The extension reach of the explosion could damage the outer string on the back side of the tubing being cut.

Rotating tubing cutters have been run in on wireline where power was transmitted to an electric motor in the bottom hole assembly as illustrated in U.S. Pat. No. 7,370,703.

Other assemblies disclose the use of a tubing cutter but the focus is on how the blades are extended or how the cutter is anchored with no details about the drive system other than stating that there is a driver and that the traditional conveyances for cutters such as coiled tubing, wireline or slickline can be used. Some examples are U.S. Pat. Nos. 7,478,982 and 7,575,056.

Slickline has been used in conjunction with an anchor and tubular cutter that is rotated by a motor having a battery as the power supply as shown in U.S. Pat. No. 8,210,251. Tractors have been used with local power supply in the form of a battery to advance a BHA to the desired location in a deviated wellbore while at the same time avoiding slack or over-tensioning the slickline used to deliver the BHA as is described in U.S. Pat. No. 8,151,902.

There are many occasions where a coiled tubing unit or an E-line rig is not available and a need to cut tubing or mill arises. Under those circumstances it would be advantageous to use a slickline supported cutter. Since a slickline cannot convey power and a self contained power supply in the bottom hole assembly, such as a battery, may not have the output to get the job done or may not even fit in a confined location of a small wellbore, the present invention provides an alternative to make the tubing cut or to advance a mill as a fish is being milled. A fish is the stuck object in the wellbore. A washover mill goes around the exterior of the fish such as a packer to undermine the slips so that the packer can be released and in general fall further down in the hole or actually get fished out. A washover mill can be fitted with a tool to grasp the released fish for retrieval. A slickline or wireline cannot push a mill forward as the milling progresses and thus the present invention contemplates ways to deploy a fluid motor run on electric line or slick line to advance the mill or to put a force on the mill against the fish during milling. More specifically telescoping joints that are spring loaded with fluid pressure are contemplated as well as a tractor in conjunction with a telescoping joint with the tractor powered by wireline or a local power source such as an onboard battery.

The preferred deployments of the invention is in a well with production tubing inside casing where the tubing is cut to be freed from a production packer by allowing it to extend so that its slips and sealing system can retract or washover milling of a stuck fish. In the context of this application, the reference to "tubing" is to tubular strings in a wellbore and includes casing, production or injection tubing in casing or tubulars in other environments that need to be cut. In the preferred mode the rig pumps provide fluid under pressure around the bottom hole assembly that is supported in the tubular to be cut in a sealed manner and retained against reaction torque from the cutting or milling operation. The pumped fluid enters the bottom hole assembly through a ported sub and goes to a fluid driven pump such a progressing cavity pump to operate the cutter or mill. With a telescoping assembly to let a mill advance, the pressurized fluid can be used as a force to compress springs that are used to keep a force on the mill and against the fish as the milling progresses. Exhaust fluid from the pump goes out the tubing and back to the surface through perforated holes in the tubing allowing access to the annulus where the tubing inside the casing is being cut or a fish is being milled out. Those skilled in the art will more readily appreciate other aspects of the invention from a review of the detailed description and the associated drawings that appear below while recognizing that the full scope of the invention is to be found in the appended claims.

SUMMARY OF THE INVENTION

A tubing cutter is run in with a bottom hole assembly that includes a seal and support within the tubing to be cut. A ported sub allows pressurized fluid pumped from the surface to enter the bottom hole assembly above the sealed support location and to be directed to set an anchor and to a fluid driven motor such as a progressive cavity motor that is in turn connected to the tubing cutter at the rotor of the progressive cavity motor. The rotation of the cutter with its blades extended cuts the tubular as the fluid exiting the stator goes to the lower end of the tubing being cut and can return to the surface through an annulus around the tubing to be cut. Other configurations such as cutting casing or cutting casing through tubing as well as milling are also envisioned. Milling a fish such as with an overshot mill or another type of mill can be accomplished with a telescoping assembly that has a bias against the mill using springs, for example, where the springs are compressed with the circulating pressurized fluid.

DETAILED DESCRIPTION OF THE PREFERRED EMBODIMENT

Figure 1A:
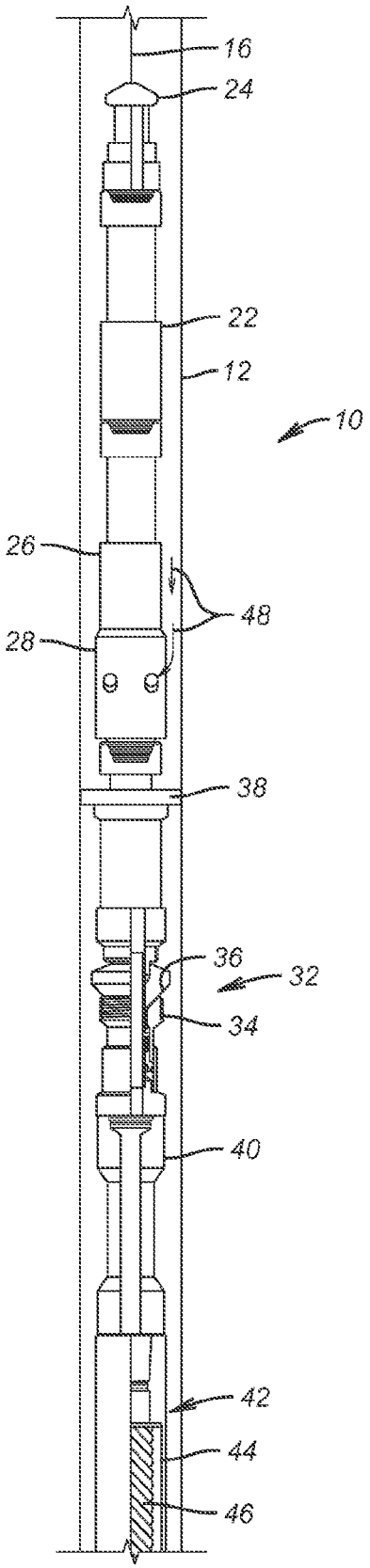
FIGS. 1*a*-1*b* show the arrangement of a bottom hole assembly with the tubing to be cut omitted for clarity.
Figure 1B:
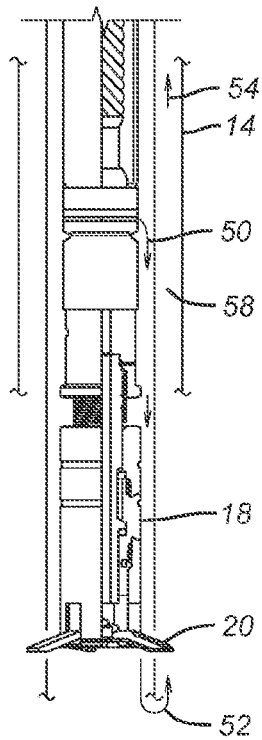

In one embodiment, the cutter assembly 10 is preferably positioned in a tubular string 12 that is disposed in a surrounding string such as casing 14 shown in part in FIG. 1*a*. A slickline 16 or alternatively a wireline, if available at the surface, supports the illustrated equipment down to the cutter 18 shown in FIG. 1*a* with cutting blades 20 extended into the cutting position. The slickline 16 supports an optional accelerator 22 for use in shallow depth applications. Other familiar components when running slickline are employed in the assembly 10 such as a fishing neck 24 and a jar tool such as 26. The jar tool 26 allows jarring to get unstuck while the fishing neck 24 allows the assembly to be fished out if the jar tool 26 does not help it break loose. A ported sub 28 has ports 30 that preferably stay open.

The equipment shown below the ported sub 28 is schematically illustrated to perform a sealing function in string 12 so that fluid pumped from the surface will go into ports 30 and for securing the bottom hole assembly against reaction torque from the cutting operation as the blades 20 are rotated. The anchor tool 32 has slips 34 driven along ramps 36 to bite the inside of the string 12 for support of the weight of the assembly 10 and to retain the assembly 10 against rotation. A seal 38 is radially extendable in a variety of ways. It can be made of a swelling material that reacts to well fluids or added fluids to swell and seal. It can be set against the inner wall of the string 12 by longitudinal compression that is initiated mechanically such as when a slickline 16 is in use or it can be actuated electrically using a setting tool powered by power delivered through a wireline, when available. If the string 12 has a landing nipple that has a seal bore, on the other hand, the seal 38 can just be advanced into the seal bore to get a seal. The no-go that is typically provided in a landing nipple can be configured not only for weight support but also for a rotational lock of the assembly 10. In those cases with latching into a landing nipple the anchor 32 would not be used as dogs going into a profile provide weight support and a rotational lock.

One or more pipe sections 40 can be provided for proper spacing of the blades 20 when working off a landing nipple. When using an anchor 32 that can be deployed as needed, the pipe sections 40 can be eliminated. A downhole motor 42, preferably a progressive cavity Moineau pump is used with a stationary stator 44 and a rotor 46 operatively connected to the tubing cutter 18. Arrows 48 represent pumped fluid from the surface going down the string 12 and entering the ports 30. From there the flow continues within the assembly 10 to the stator 44 which sets the rotor 46 turning. The fluid is exhausted from the stator 46 and follows the path of arrows 50, 52 and 54 to get back to the surface through the annulus 58 between strings 12 and 14.

When used in a cased hole to cut casing the exhaust fluid from the motor 42 can be directed further downhole such as into a formation, although in some application this may not be desirable. With larger sizes there can also be issues of the weight capacity of the slickline to support the assembly 10. The preferred application is in cutting production or injection tubing such as in applications to sever a packer body to allow it to be released so that it can be removed with the tubing being severed. The anchor and seal 32 and 38 can be configured for multiple deployments at different locations in a single trip so that more than one cut of the tubular 12 can take place in one trip. Various configurations of rotating cutters are envisioned that are responsive to rotational input to operate. The tubing cutter 18 is a known product adapted to be used in the assembly 10.

In a broad sense a bottom hole assembly 10 can be run in on a cable, whether slickline or a wireline, if available, for support in a tubular to be cut and the ability to divert flow pumped into the tubular to a downhole motor to make the cut with a rotary bladed cutter or in the alternative with a fluid jet or jets that can cut through the tubing either with or without body rotation of the cutter. The motor 42 can drive a downhole pump that builds pressure that is exhausted through jet nozzles in the cutter 18. Alternatively the tubing 12 above the seal 38 can be raised to a high enough pressure to operate cutting jets in the cutter 18. The support cable can be selectively released to be removed from the wellbore after the tubular is cut. Depending on the cutter configuration the tubing can be cut circumferentially for 360 degrees to remove a part of it or an opening of a desired shape can also be cut into the tubular 12 depending on the cutter configuration.

Figure 2:
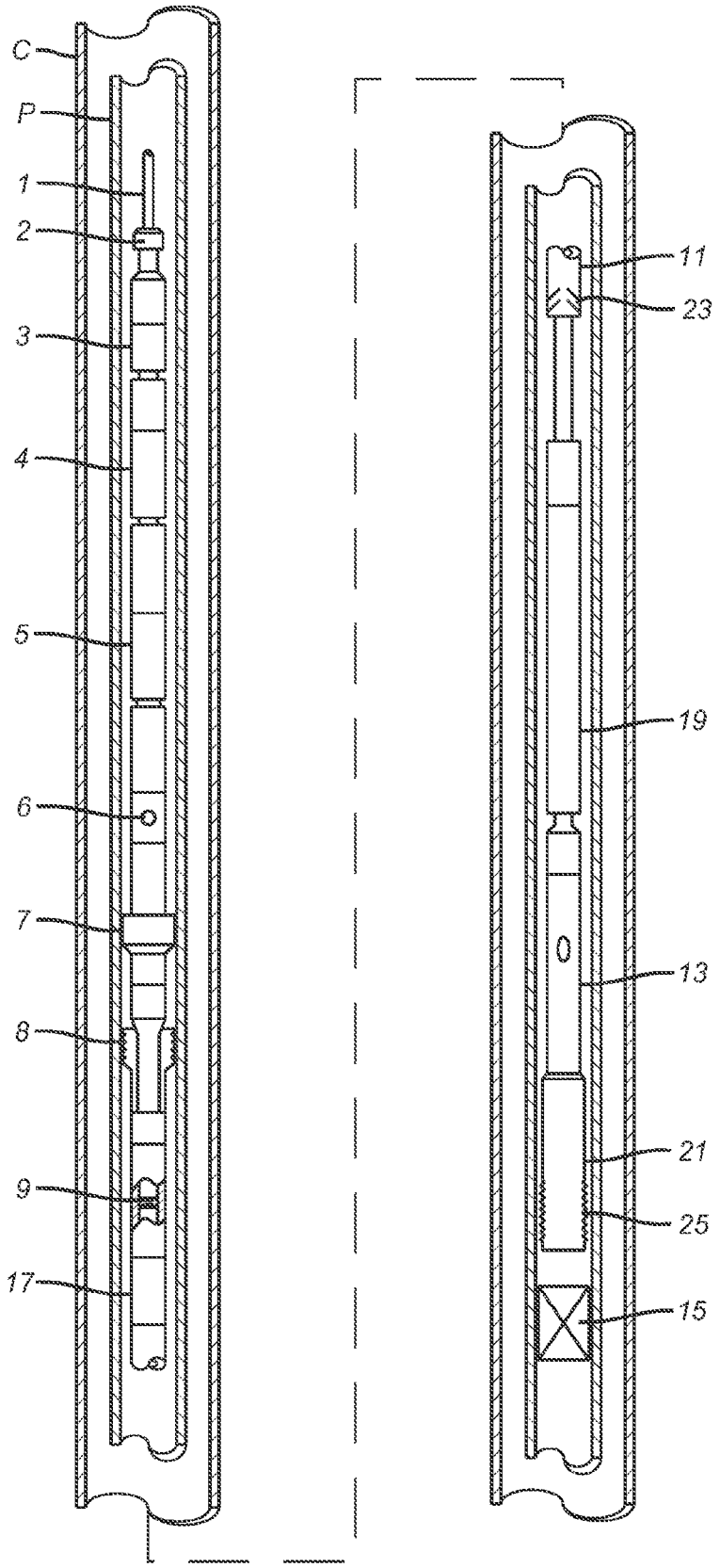
FIG. 2 is a run in position of the preferred embodiment using a washover mill.

In the preferred embodiment shown in FIG. 2, production tubing P is run inside of casing C. A wireline or slickline 1 supports a fish neck assembly 2 followed by a swivel 3. An optional accelerator 4 is next followed by spang jars 5. The assembly thus far is made up of components known in the art and assembled in an order that is also known in the art for functions that are equally well known. For example, the swivel 3 prevents the line 1 from getting wound up if for example during milling of the fish 15 the anchor 8 breaks loose and allows reaction torque to occur up the BHA. The induced rotation will turn the swivel 3 but the line 1 will not turn. Spang jars 5 are commonly used to get the BHA unstuck.

The FIG. 2 BHA uses a fluid circulation scheme that diverts fluid pumped from the surface by the setting of a packer 7 that can be mechanically or electrically set, for example. Fluid from the surface is diverted into the drain sub 6 which is basically a ported sub. The fluid path runs through the mandrel of the packer 7 and the anchor 8 that is adjacent in the BHA. The fluid path is closed for run in at rupture disc 9. Those skilled in the art will realize that other types of removable barriers or valves can be used without departing from the invention. However, if a rupture disc 9 is used which breaks into pieces when actuated with fluid pressure from above, then a screen sub 17 is used to catch the pieces and prevent them from getting to the mud motor 19 that has close clearances and is preferably a progressing cavity style pump.

Compensator 11 is a telescoping assembly preferably with a bias toward the shoe or mill 21. The bias can be a stack of Belleville washers 23 that are collapsed with set down weight of the BHA in a more vertical hole or that are compressed with pressure differential from flow passing through the stack of Belleville washers 23. The compensator 11 pushes against the mud motor 19 which is then followed by a vacuum operated debris cleanup tool 13 that uses the flow that entered the BHA at sub 6 where such flow is first used to break the rupture disc 9 after having set the anchor 8 so that flow can pass through the mud motor 19 and compress the washers 23. Other types of biasing devices can be used as well as just the back pressure created by forcing fluid through the venturi nozzles in the debris cleanup tool 13. The debris cleanup tool 13 is of a type well known in the art such as the VACS tool sold by Baker Hughes Incorporated and discussed in U.S. Pat. No. 6,276,452. The mill 21 is preferably a washover type mill that takes cuttings on the inside as it descends onto the fish 15 and in so doing breaks the fish 15 loose such as by milling away slips or a sealing element for a packer, for example. The fish 15 can be allowed to drop once broken loose or it can be retained by the mill with a schematically illustrated grasping device 25 that can be a ratchet, or surface texture or some device that penetrates the fish 15 during milling to avoid dropping it into the well.

Figure 3:
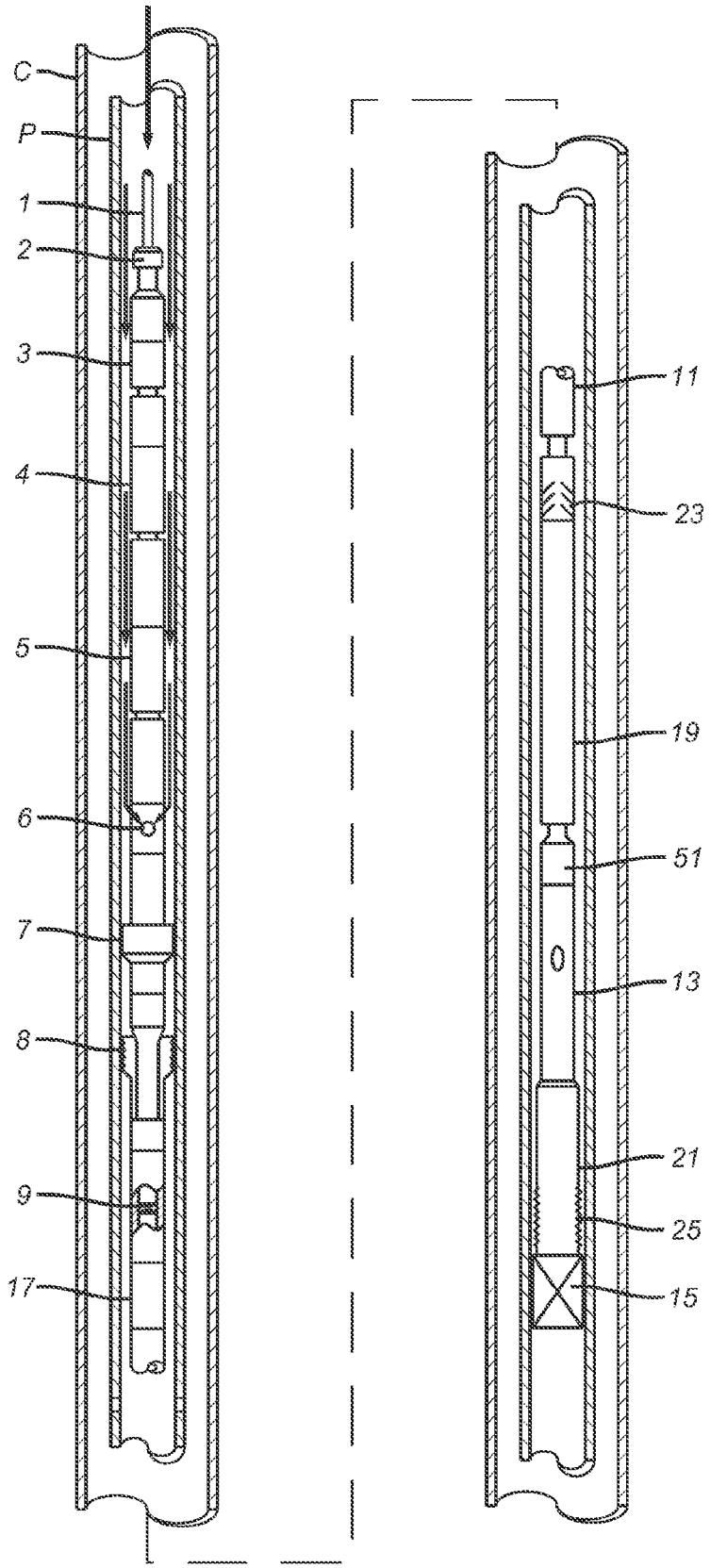
FIG. 3 is the view of FIG. 2 with the mill landed on the fish.

FIG. 3 is the same as FIG. 2 with the mill 21 now lowered onto the fish 15. The anchor 8 is not yet set and the rupture disc 9 is still intact. The compensator 11 is collapsed using the pressure of the circulating fluid which collapses the Belleville washers 23 to provide a net force on the mill 21 and to extend the compensator 11 as the mill moves axially during milling of the fish 15.

Figure 4:
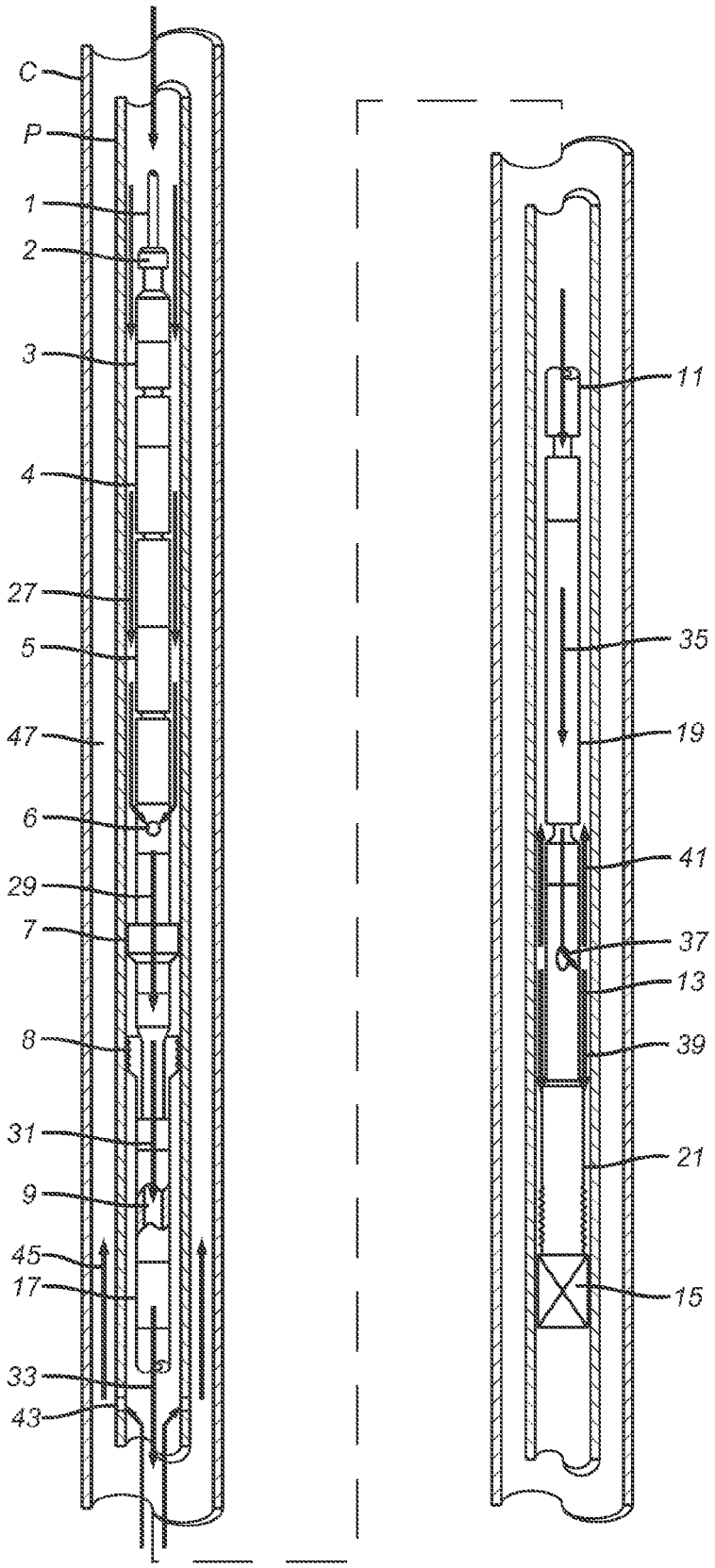
FIG. 4 is the view of FIG. 3 during milling.

FIG. 4 shows the onset of delivery of pressurized fluid into the production tubing P using arrows 27 going into ported sub 6. Arrow 29 shows flow going through the packer 7 and sets the anchor 8 before breaking the rupture disc 9 at flow arrow 31. Flow continues via arrow 33 into the mud motor 19 as indicated by arrow 35. The flow stream exits the debris catcher 13 as the eductor exit flow from the VACS tool through ports 37 where some of the flow continues down toward the mill 21 as shown by arrow 39 and the rest of the flow goes up the production tubing P to ports 43 as indicated by arrow 45. The flow continues up the annulus 47 to the surface. As the milling progresses the mill 21 is biased by the Belleville washers 23 or some other biasing device to continue to extend the compensator 11 and to keep weight on the mill 21 as it is rotated by the mud motor 19. The compensator 11 further extends the mill 21 as the fish 15 is milled free.

Figure 5:
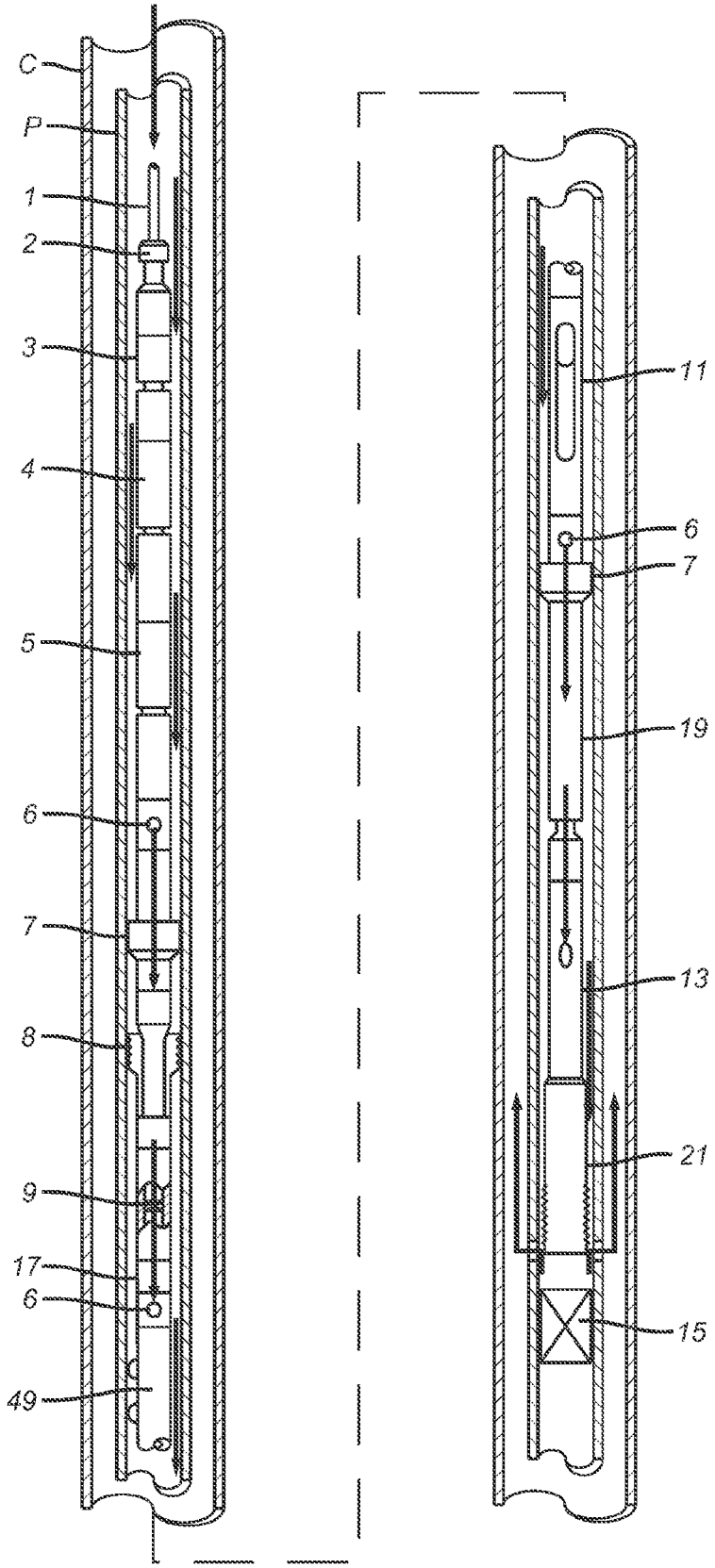
FIG. 5 is an alternative embodiment to the view in FIG. 2 using a tractor to hold weight on the mill and advance the mill as the milling progresses.

FIG. 5 is essentially the same as FIG. 4 with the difference being that the compensator 11 is still a telescoping joint but the weight is kept on the mill 21 as a tractor 49 allows the telescoping joint to extend as the mill 21 advances to keep a load on the mill 21 as it mills the fish 15. The tractor 49 can be placed in different locations with respect to the telescoping joint or compensator 11. Line 1 is preferably a wireline with power supplied to the tractor 49 routed through the BHA or/and outside the BHA. For example the power line can run into the BHA at item 6 and through the BHA to the screen sub to the tractor 49. The tractor 49 is a design well known in the art such as shown in U.S. Pat. No. 7,143,843.

Those skilled in the art will appreciate that the present invention allows running in a BHA that includes a mud motor driver on slickline or wireline and to perform a milling operation where the mill advances as the milling progresses and where the BHA accommodates the axial travel of the mill while allowing force to be applied to the mill using a compensation system that comprises a telescoping assembly with a biasing feature that is activated in various ways. One way is using a tractor and another is using mechanical or fluid force. Belleville washers can be compressed as the telescoping assembly has its length reduced prior to the onset of milling. As the milling progresses the compensating joint extends under the force of the washers to allow the mill to progress under a force delivered by the washers. The mill can be any style although a washover type with a retention feature for the fish is preferred. Depending on the mill style the circulation pattern or even the use of a debris catcher can be altered to take into account the flow path for the debris and how to best capture it either downhole or/and at the surface. Alternatively the fish can be allowed to fall or be pushed further in a wellbore once milled loose. The tractor can have wheels or tracks and can be on either end of the compensating assembly or telescoping joint. Debris collection devices can be optionally used and can be of a variety of known styles. The rupture disc 9 can be an opening that selectively opens and closes so that the BHA can mill at more than a single location in a single trip. Stopping fluid flow allows the BHA to release the anchor 8 so that the BHA can be allowed to advance or be picked up for actuation at another location in a wellbore or a lateral in the same trip. The selectively opened valve that can replace the rupture disc can be pressure responsive to open at a predetermined pressure and otherwise close to permit another setting of the packer in a different location. Various steering tools can also be used to aid in arriving at the proper location or locations.

A fluid powered vibration tool 51 can be associated with the mill 21 to either grab the fish 15 to try to break it loose with vibration either when not milling or during milling.

The above description is illustrative of the preferred embodiment and many modifications may be made by those skilled in the art without departing from the invention whose scope is to be determined from the literal and equivalent scope of the claims below.

We claim:

1. A method of operating a tool in a borehole leading to a subterranean location, comprising:
- delivering the tool to a first subterranean location at least in part on a cable;
- pumping fluid into the borehole to pressurize at least a portion of the borehole;
- using said pressure to operate said tool;
- moving all of said tool to an axially spaced second subterranean location while using said pressure to operate said tool.

2. The method of claim 1, comprising:
- using a slickline or wireline as said cable.

3. A method of operating a tool in a borehole leading to a subterranean location, comprising:
- delivering the tool to the subterranean location at least in part on a cable;
- pumping fluid into the borehole to pressurize at least a portion of the borehole;
- using said pressure to operate said tool;
- moving said tool axially while using said pressure to operate said tool;
- including a telescoping joint in a bottom hole assembly that includes said tool for said moving said tool axially.

4. The method of claim 3, comprising:
- biasing against said tool when said tool is operated.

5. The method of claim 3, comprising:
- extending said telescoping joint when said tool is operated.

6. The method of claim 5, comprising:
- using at least one spring for said biasing.

7. The method of claim 6, comprising:
- energizing said spring with pressure delivering said pumped fluid.

8. The method of claim 7, comprising:
- using a Belleville washer stack for said biasing.

9. The method of claim 3, comprising:
- associating a tractor with said telescoping joint to axially advance the tool when operating.

10. A method of operating a tool in a borehole leading to a subterranean location, comprising:
- delivering the tool to the subterranean location at least in part on a cable;
- pumping fluid into the borehole to pressurize at least a portion of the borehole;
- using said pressure to operate said tool;
- moving said tool axially while using said pressure to operate said tool;
- using a mill as said tool for release of a fish at the subterranean location.

11. The method of claim 10, comprising:

allowing the fish to drop in the borehole after release or grasping said fish for retrieval from the borehole after the fish is released.

12. The method of claim 10, comprising:

using a washover mill for said tool;

capturing generated debris using the fluid pumped into the borehole through a debris removal tool mounted in a bottom hole assembly with said mill.

13. The method of claim 10, comprising:

vibrating said mill using the fluid pumped into the borehole through a vibration tool mounted in a bottom hole assembly with said mill while in contact with the fish.

14. The method of claim 10, comprising:

driving a motor operably connected to said mill with said pumping.

15. The method of claim 14, comprising:

diverting said pumped fluid to said motor.

16. The method of claim 15, comprising:

using a progressing cavity device as said motor.

17. The method of claim 15, comprising:

directing fluid exhausted from said motor to a debris removal tool or a vibrator.

18. The method of claim 17, comprising:

flowing said exhausted fluid through an annular space defined between production tubing and a surrounding tubular.

19. The method of claim 15, comprising:

accomplishing said diverting with an exterior seal on said assembly.

20. The method of claim 19, comprising:

actuating said seal to seal a portion of the borehole.

21. The method of claim 19, comprising:

providing a seal bore a tubular string in which said fish is located; and inserting said seal into said seal bore to accomplish said diverting.

22. The method of claim 19, comprising:

providing a ported sub adjacent said seal; and directing flow through said ported sub and into said motor.

23. The method of claim 19, comprising:

providing a hydraulically actuated anchor in said assembly.

24. The method of claim 23, comprising:

locating said anchor between said seal and said motor;

using said diverted fluid to actuate both said anchor and said motor.

* * * * *